US010123111B2

(12) United States Patent
Gunness

(10) Patent No.: US 10,123,111 B2
(45) Date of Patent: Nov. 6, 2018

(54) PASSIVE CARDIOID SPEAKER

(71) Applicant: Fulcrum Acoustic, LLC, Rochester, NY (US)

(72) Inventor: David W. Gunness, Sutton, MA (US)

(73) Assignee: Fulcrum Acoustic, LLC, Whitinsville, MA (US)

( * ) Notice: Subject to any disclaimer, the term of this patent is extended or adjusted under 35 U.S.C. 154(b) by 0 days.

(21) Appl. No.: 15/172,880

(22) Filed: Jun. 3, 2016

(65) Prior Publication Data

US 2017/0353787 A1 Dec. 7, 2017

(51) Int. Cl.

| | |
|---|---|
| ***H04R 1/02*** | (2006.01) |
| ***H04R 1/34*** | (2006.01) |
| ***H04R 1/28*** | (2006.01) |
| ***H04R 1/30*** | (2006.01) |
| ***H04R 7/16*** | (2006.01) |

(52) U.S. Cl.

CPC ..... *H04R 1/347* (2013.01); *H04R 1/288* (2013.01); *H04R 1/2842* (2013.01); *H04R 1/30* (2013.01); *H04R 7/16* (2013.01); *H04R 1/021* (2013.01); *H04R 1/2819* (2013.01)

(58) Field of Classification Search

CPC ..... H04R 1/347; H04R 1/2842; H04R 1/288; H04R 1/30; H04R 7/16; H04R 1/2838; H04R 1/2807

USPC ..... 381/340, 341, 345, 338, 386, 334

See application file for complete search history.

(56) References Cited

U.S. PATENT DOCUMENTS 3,722,616 A 3/1973 Beavers
3,739,096 A 6/1973 Iding
4,054,748 A * 10/1977 Balogh ..... H04R 1/347 181/199
6,259,798 B1 7/2001 Perkins et al.
6,665,412 B1 12/2003 Mizoguchi
(Continued)

FOREIGN PATENT DOCUMENTS

KR 10-2004-0085709 A 10/2004

OTHER PUBLICATIONS

Lautsprecher Und Beschallungstechnik GMBH, "RL 180 N Polar Directional Loudspeaker with Cardioid Pattern data sheet", 3 pages, Munchen, Germany.

(Continued)

*Primary Examiner* — Sunita Joshi

(74) *Attorney, Agent, or Firm* — Cesari and McKenna, LLP

(57) ABSTRACT

A passive cardioid acoustical system, or loudspeaker, is described which is driven with a single electrical signal and provides a useful reduction of low-frequency sound intensity in the rearward direction while producing relatively high low-frequency sound intensity in the forward direction. This is accomplished by an acoustical circuit which modifies the magnitude and phase of sound radiated by the interior side of a vibrating diaphragm or diaphragms, and combines it with the sound radiated by the exterior side of the diaphragm or diaphragms, so as to cancel part of the rearward radiation and reinforce the forward radiation. The passive cardioid loudspeaker described employs an improved acoustical circuit which allows improved efficiency, as well as greater flexibility with regard to the size, maximum output, and effective frequency range of the loudspeaker, as compared to prior art.

17 Claims, 7 Drawing Sheets

(56) References Cited

U.S. PATENT DOCUMENTS

| | | | | |
|---|---|---|---|---|
| 7,463,744 | B2 * | 12/2008 | Parker | H04R 1/02 381/161 |
| 2002/0154788 | A1 | 10/2002 | Tsai | |
| 2010/0254558 | A1 | 10/2010 | Meyer et al. | |
| 2014/0341394 | A1 * | 11/2014 | Croft | H04R 1/2811 381/102 |

OTHER PUBLICATIONS

Meyer Sound Laboratories, Inc., "MM-4XPD: Directional Miniature Self-Powered Loudspeaker datasheet", 2014, 2 pages, Berkeley, California.

Iding, Unidirectionally Radiating Loudspeakers. Paper of the Convention '72 14-16.3.1972 Munich Germany; 6 pages.

International Search Report and Written Opinion received in PCT Application No. PCT/US2017/035753, dated Aug. 31, 2017; 11 pages.

* cited by examiner

PASSIVE CARDIOID SPEAKER

BACKGROUND

Technical Field

This disclosure relates to loudspeakers. In particular, it relates to loudspeakers with beneficial directional radiation patterns at low frequencies.

Description of Related Art

Conventional loudspeakers become progressively less directional with decreasing frequency, such that at the lowest frequencies reproduced by the loudspeaker, the intensity of the sound radiated to the rear of the loudspeaker is approximately equal to the intensity of the sound radiated in the forward direction.

If two sound sources are separated by some distance and driven with signals of opposite polarity, and if the signal applied to the rear source is delayed by a length of time equal to the propagation time between the two sources, a desirable radiation pattern is produced at low frequencies. This radiation pattern projects sound with higher intensity in the forward direction and lower intensity in the rearward direction. A plot of the radiation intensity has the general shape of a heart, and because of that, is often referred to as a cardioid radiation pattern. Varying the delay to the rear sound source produces variations of the cardioid pattern. The common variations, in order of increasing rear delay times and decreasing directivity index, are named hypercardioid, supercardioid, cardioid, and subcardioid. These variations are often referred to, collectively, as "cardioid patterns."

A similar result may be obtained using a single sound source. The sound emanating from the back side of a vibrating diaphragm has inverse polarity relative to the sound emanating from the front side of the diaphragm. If the rear radiation is constrained by an enclosure, but allowed to exit the enclosure through a port located at a distance from the origin of the front radiation; and, if the rear radiation is delayed by an appropriately designed acoustical system, then a cardioid radiation pattern may be produced over a limited bandwidth. Such a device is referred to as a passive cardioid loudspeaker.

Passive cardioid loudspeakers, as taught in prior art, such as U.S. Pat. No. 3,722,616 (Bobby R. Beavers), U.S. Pat. No. 3,739,096 (Wilhelmus Hermanus Iding), U.S. Pat. No. 6,665,412 (Akio Mizoguchi), and US2010/0254558 (John D. Meyer et al) employ an enclosure with a simple opening and some acoustical resistance to provide an approximation of a first order low-pass filter. The phase response of such a filter approximates the phase response associated with time delay, but only at very low frequencies. The equivalent amount of delay provided is directly associated with the corner frequency, f3, of the low pass filter.

FIG. 1A shows a graph 100A of the amplitude response of a 100 Hz first-order low-pass filter compared to the amplitude response of a fixed (1.52 ms, indicated by the constant-level line) delay.

FIG. 1B is a graph 100B of the phase response of a first-order low-pass filter (indicated by the nearly horizontal line) compared to the phase response of a pure delay (1.52 ms), with the filter being selected to have similar phase response at very low frequencies as the fixed delay.

The frequency range over which rear attenuation can be achieved is limited to the frequency range over which the phase response approximates delay (<100 Hz in the example of FIG. 1B); and the distance between the resistive port and the vibrating diaphragm must be chosen so as to obtain the necessary phase relationship between the front and rear radiation. Thus, a loudspeaker constructed according to Beavers and Meyer has limited applicability, due to the limited phase delay obtainable in a given frequency range, and due to the requirement that the distance between the origins of the front and rear radiation be dictated by the available phase delay. Specifically, the prior art is limited to relatively small loudspeakers with relatively little output.

A second disadvantage of the prior art is that a simple opening combined with acoustical resistance may constitute an imperfect low pass filter, so that high-frequency sound impinging on the port opening may radiate through the opening in a direction in which sound attenuation is desired.

A low pass filter of higher order produces more effective delay for a given corner frequency, as shown in FIGS. 2A-B and 3A-B. Additionally, as is shown in FIGS. 2A-B and 3A-B, the phase response matches that of pure delay to higher frequencies relative to the low-pass corner frequency.

FIG. 2A shows a graph 200A of the amplitude response of a 100 Hz second-order low-pass filter compared to the amplitude response of a fixed (2.08 ms) delay.

FIG. 2B shows a graph 200B of the phase response of a 100 Hz second-order low-pass filter compared to the phase response of a fixed (2.08 ms) delay.

FIG. 3A shows a graph 300A of the amplitude response of a 100 Hz fourth-order low-pass filter compared to the amplitude response of a fixed (3.33 ms) delay.

FIG. 3B shows a graph 300B of the phase response of a 100 Hz fourth-order low-pass filter compared to the phase response of a fixed (3.33 ms) delay.

FIG. 4 depicts a graph 400 showing the forward summation of rear radiation with front radiation, cardioid with 30-in. Spacing.

A limitation of prior art cardioid loudspeakers is that at certain high frequencies, the delay of the rear radiation in the forward direction is equivalent to one half of a period, or odd multiples of one half of one period. Consequently, the response in the forward direction has deep nulls at those frequencies. The frequency of the first null constitutes a limitation of the uppermost usable frequency. This null is shown at about 230 Hz in the graph 400 of FIG. 4. Additionally, below a certain lower frequency, the rear radiation propagating forward interferes destructively with the front radiation propagating forward, which limits the low frequency output in the forward direction. Destructive interference may be seen below 40 Hz in the graph in FIG. 4. Both the low frequency limit and the high frequency limit may be shifted up or down in frequency together by changing the distance between the front and rear sources and adjusting the phase delay to match the change in spacing.

SUMMARY

The present invention addresses the noted limitations of the prior art, and provides passive cardioid acoustical systems (e.g., loudspeakers) that produce relatively high sound pressure in the forward direction, consistent attenuation in the rearward direction, and significant flexibility. This flexibility allows loudspeakers of various sizes to be optimized over various frequency ranges, and allows the radiation pattern to be optimized to satisfy the objectives of a given design. Compared to the prior art, the present invention provides loudspeakers that are effective at lower frequencies for a given enclosure size, are effective in larger enclosure sizes for a given frequency range, may be used to produce higher output, and may allow low frequency cardioid behavior in a full-range loudspeaker.

Acoustical systems according to the present invention combine a vibrating diaphragm (e.g., a cone of a loudspeaker as driven by a transducer) with an acoustical low-pass filter of order greater than one. In general, the acoustical elements that are incorporated consist of one or more ducts, one or more enclosed air volumes, and one or more acoustical resistances which resist the motion of air that occurs when sound waves propagate through the ducts. To provide a low-pass filter with order greater than one, the acoustical system includes at least one enclosed air volume in combination with at least one duct. To provide an acoustical low-pass filter with a desired frequency response (e.g., one set by design requirements) at least one acoustical resistance is provided for the system. In preferred embodiments, the ducts are generally elongated in shape, though this configuration is not required.

A further aspect of the invention is the addition of a relatively short horn on the forward facing surface of the diaphragm. This horn delays the portion of the front radiation which propagates in the rearward direction, and increases the directionality of the forward facing radiating surface at somewhat higher frequencies. With appropriate selection of dimensions, this increased directionality allows the acoustical low-pass filter to have a lower corner frequency, which increases its delay, which allows the diaphragm-to-port spacing to be increased, which further increases the forward propagating sound pressure while extending the bandwidth over which useful rear attenuation may be achieved.

A yet further aspect of the invention is an arrangement of elongated ducts that lies perpendicular (or substantially so) to the primary axis of the loudspeaker, with its entrance located near the back of the loudspeaker enclosure, and its exits located around the perimeter. This enhancement allows greater flexibility with regard to the acoustical mass of the elongated ducts, the surface area of the port exits, additional delay corresponding to the length of the ducts, and the location of the port exits. The ducts may have various shapes; examples include but are not limited to rectangular and tapered (trapezoidal). Various combinations of these parameters may be used to obtain uniquely beneficial directional patterns, including patterns that differ from the standard family of shapes in useful ways. One such unique pattern provides more attenuation at 90 degrees off axis than any of the standard cardioid forms.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Figure 1A:
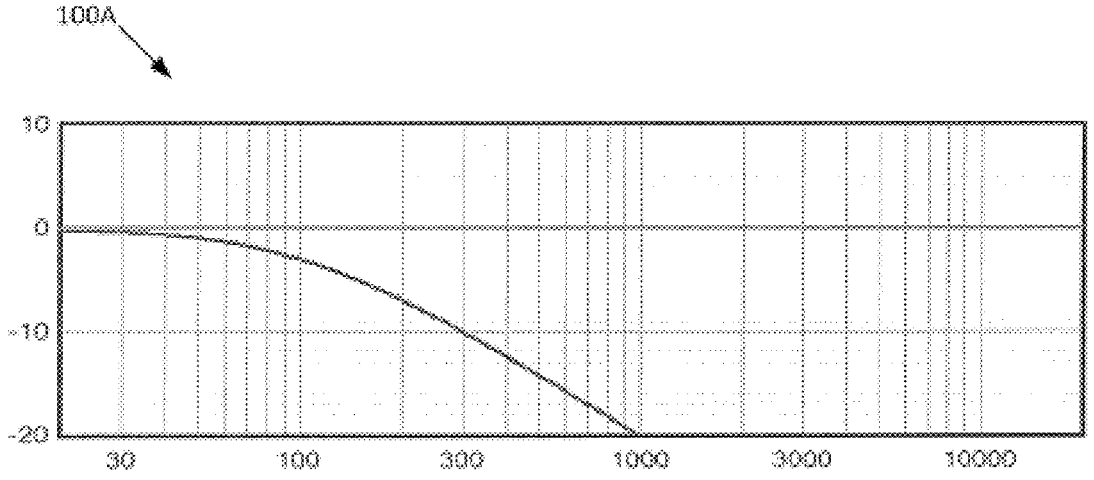
FIG. 1A (PRIOR ART)
FIG. 1A depicts a graph of the amplitude response of a 100 Hz first order low-pass filter vs. amplitude response of 1.52 ms of delay.
Figure 1B:
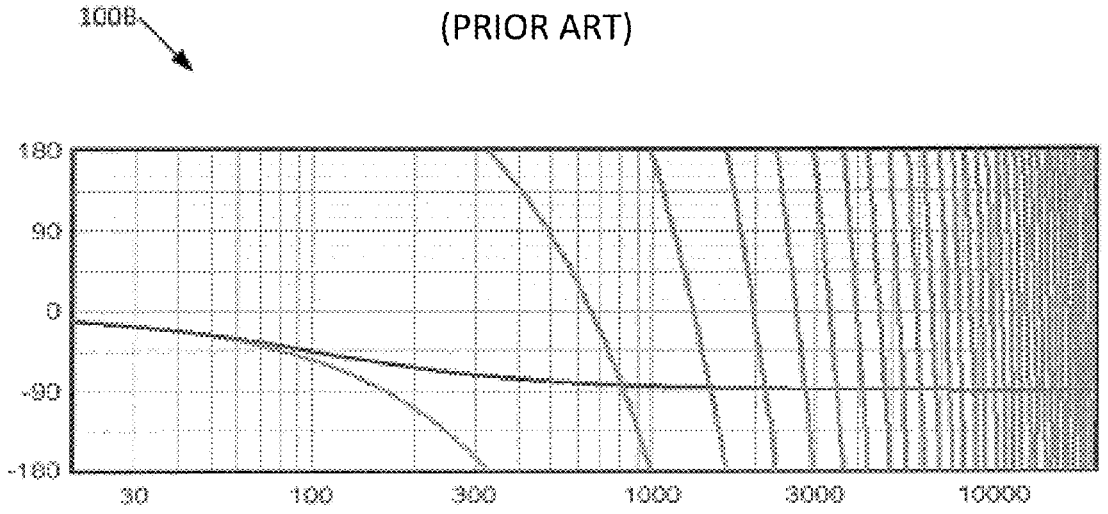
FIG. 1B (PRIOR ART)
FIG. 1B depicts a graph showing the phase response of a 100 Hz first-order low-pass filter vs. phase response of 1.52 ms of delay.

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Acoustical systems according to the present invention combine a vibrating diaphragm (e.g., a cone of a loudspeaker) with an acoustical low-pass filter of order greater than one. In general, the acoustical elements that are incorporated consist of one or more ducts, one or more enclosed air volumes, and one or more acoustical resistances which resist the motion of air that occurs when sound waves propagate through the ducts. To provide a low-pass filter with order greater than one, the acoustical system includes at least one enclosed air volume in combination with at least one duct. To provide an acoustical low-pass filter with a desired frequency response (e.g., one set by design requirements) at least one acoustical resistance is provided for the system. In preferred embodiments, the ducts are generally elongated in shape, though this configuration is not required.

The acoustical resistance provides damping to the low-pass filter, which reduces or eliminates the resonant peak that would otherwise be evident in the response of the low-pass filter. The particular shape of a second-order low-pass filter is defined by a dimensionless quantity, Q, or "quality factor". To obtain a desired value of Q, the resistive elements are selected and designed to have a particular value of acoustical resistance, e.g., as measured in Rayls or rayls. This resistance may be provided in one of many forms. A preferred form of acoustical resistance which has been found to provide a wide range of resistances and sufficient linearity is made of one or more layers of resistive cloth and/or reticulated foam clamped between two layers of perforated metal.

An opening combined with a duct which is substantially longer than the thickness of the enclosure wall provides an acoustical mass which is large compared to that of a simple opening; the acoustical mass of the ducted aperture is proportional to the length of the duct and inversely proportional to its cross-sectional area. By adjusting the ratio of the length of the duct to the cross-sectional area of the duct, a broad range of acoustical masses may be obtained. By increasing both the length and cross-sectional area of the duct, a required volume velocity capacity may be obtained, while still providing an acoustical mass that results in a desired corner frequency for a low-pass filter with order higher than one. In addition, displaced air moves through the duct as a wave, so it propagates at the speed of sound. Consequently, an elongated duct provides additional propagation delay to the sound output of the rear radiation ports. The ports described in the prior art (e.g., Beavers, Iding, Mizoguchi, and Meyer) are simple apertures which perforate a relatively thin enclosure wall. They cannot provide a specified acoustical mass while simultaneously providing a desired volume velocity capacity, and they cannot provide any phase delay in addition to the phase delay provided by the phase response of the acoustical low-pass filter.

For exemplary embodiments of the present invention, a larger spacing between the front radiating surface and the rear radiating port allows for higher efficiency in the frequency range of interest, but a larger spacing can require a correspondingly longer delay time. Therefore, in accordance with the present invention, acoustical circuits that provide more delay can be used to produce a loudspeaker with significantly improved performance. In addition, acoustical circuits according to the present invention, which provide more flexibility with regard to the effective delay of the phase response, can allow a practitioner to optimize the radiation pattern, including the selection of the particular form of the radiation pattern.

As provided by exemplary embodiments of the invention, the inventor has found that a subcardioid response, in particular, provides improved efficiency and more consistent response over frequency than the other forms.

One aspect of the present invention provides loudspeakers that produce relatively high sound pressure in the forward direction, consistent attenuation in the rearward direction, and significant flexibility. This flexibility allows loudspeakers of various sizes to be optimized over various frequency ranges, and allows the radiation pattern—including but not limited to a desired cardioid pattern—to be optimized to satisfy the objectives of a given design. The term "cardioid" as used herein, is not meant to exclude the other variations of radiation patterns. Compared to prior art, examples of the present invention are effective at lower frequencies for a given enclosure size, effective in larger enclosure sizes for a given frequency range, may be used to produce higher output, and may allow low frequency cardioid behavior in a full-range loudspeaker.

Figure 5:
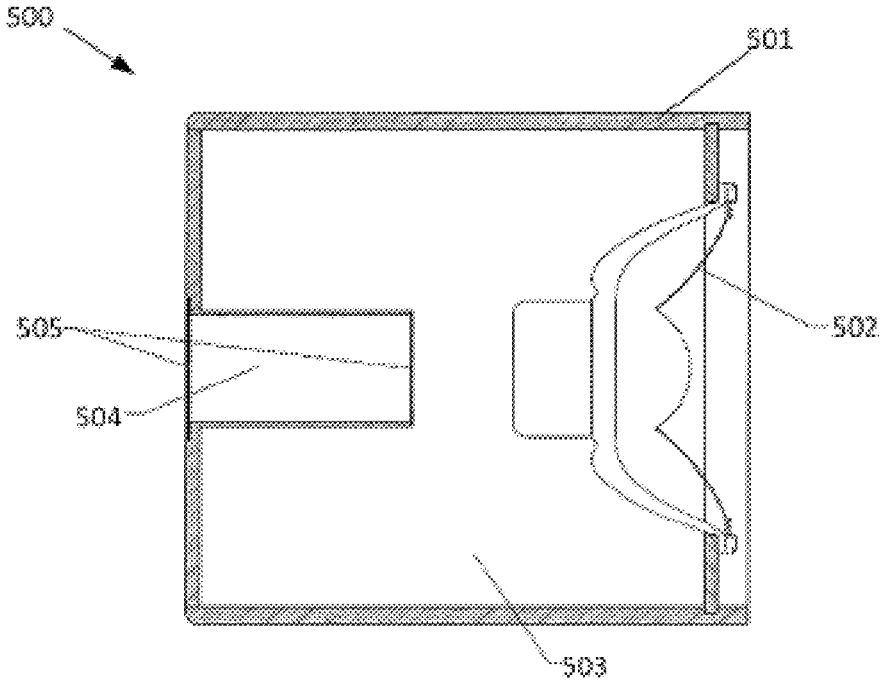
FIG. 5 depicts an example of a first embodiment of a passive cardioid acoustical system according to the present invention.

An example of a first embodiment of a passive cardioid acoustical system 500 according to the invention is depicted in FIG. 5. As shown, the system 500 includes a loudspeaker housing or enclosure 501 with a loudspeaker (or, "speaker") having a diaphragm 502. As shown, the loudspeaker includes an electromagnetic transducer, and in operation, the diaphragm 502 is moved or driven by the transducer to produce sound at a desired frequency or frequencies. For operation, the transducer can be connected to a power source and/or a signal source by suitable connections, as is known. The enclosure 501 has a volume, which presents an enclosed air volume 503 for the acoustical system 500. One or more elongated tubes, also referred to as ducts, 504 are present at or near the back (relative to the loudspeaker position) of the enclosure 501. One or more acoustically resistive elements or obstructions 505 are located at one or both ends of, or within, each elongated duct 504. The acoustical system 500 thus constructed constitutes a damped second-order low-pass filter, and is capable of producing a useful cardioid directional pattern at relatively low frequencies.

The dimensions of the elongated duct 504 may be adjusted while still maintaining the necessary low-pass corner frequency. For example, a longer duct with larger cross-sectional area can handle higher volume velocities without producing audible turbulence. Regarding the loudspeaker transducer, any suitable loudspeaker transducer may be used. Suitable examples include but are not limited to a B&C 8PS21 8-inch low frequency driver and a B&C 18TBX100 18-inch low frequency driver or the like. Any suitable material, e.g., metal, wood, plastic, may be used for the enclosure. The enclosure may be integrally formed or constructed from various joined pieces and components using suitable fasteners/fastening techniques.

Figure 6:
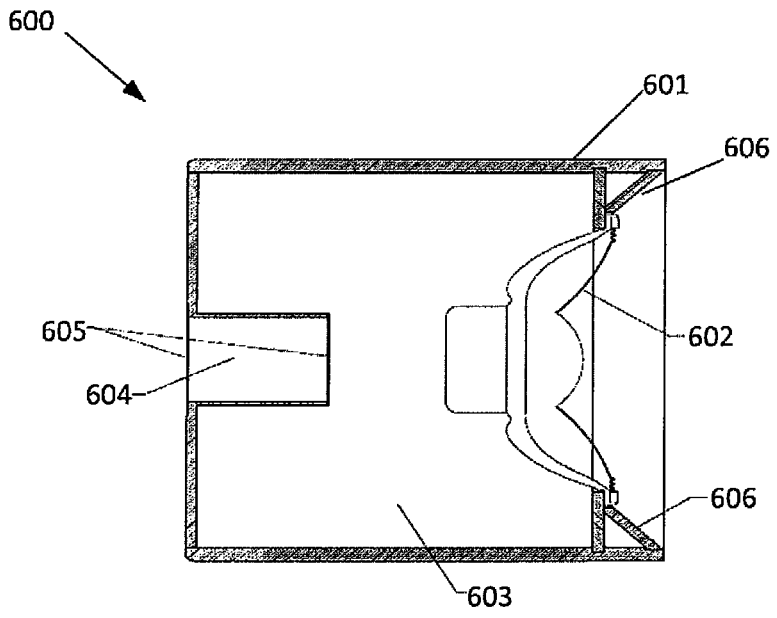
FIG. 6 depicts an example of a second embodiment of a passive cardioid acoustical system according to the present invention.

FIG. 6 depicts an example of a second embodiment of a passive cardioid acoustical system 600 according to the invention. System 600 includes a loudspeaker housing or enclosure 601 with a loudspeaker having a diaphragm 602, an enclosed air volume 603, and one or more ducts 604 present at or near the back of the enclosure 601. One or more acoustically resistive obstructions 605 are located at one or both ends of, or within, each elongated duct 604. As shown, system 600 is generally similar to system 500 of FIG. 5, but also incorporates a horn 606 on the forward facing surface of the diaphragm 602.

During operation, the sound radiated by the outside, or forward-facing surface of the diaphragm 602 propagates forward a distance before diffracting around the perimeter of the enclosure 601. Because of this, the rearward radiation from the outside diaphragm surface is delayed relative to the rearward radiation from the inside diaphragm surface. In addition, the directionality of the radiation from the outside diaphragm surface is increased. The combination of these two effects permits the use of an acoustical low-pass filter with a lower corner frequency, yielding increased output in the upper range of useable frequencies.

Figure 7:
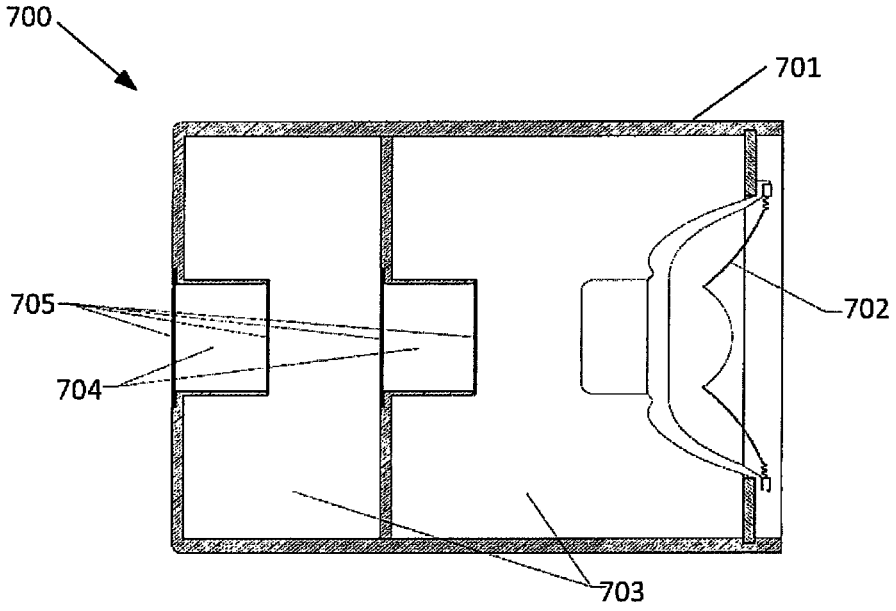
FIG. 7 depicts an example of a third embodiment of a passive cardioid acoustical system according to the present invention.

FIG. 7 shows an example of a third embodiment of a passive acoustical system 700 according to the invention. System 700 includes a housing 701, a diaphragm 702, two enclosed air volumes 703, two elongated ducts or sets of ducts 704 and one or more acoustically resistive obstructions 705 on or in each duct 704. The acoustical system 700 thus constructed constitutes a damped fourth-order low-pass filter, and is capable of producing a useful cardioid directional pattern at low frequencies in relatively large enclosures. Large enclosures require more delay of the rear radiation from the ducts, due to the increased depth of the enclosure. The effective delay of a low-pass filter is determined by the corner frequency of the filter, and a fourth-order filter provides more delay than a second-order filter with the same corner frequency. Consequently, this embodiment may be used in larger enclosures or to lower frequencies than the first two embodiments.

Note that while the two enclosed volumes 703 are shown as being in series, they may have other configurations, e.g., being in parallel, in other embodiments. Ducts 704 can be combined in other configurations as well, e.g., ducts of dissimilar shape and size may be combined to achieve a desired net acoustical mass. For further example, ducts 704 can be configured in series (a serial configuration), indirectly connected by an interposed enclosed volume 703.

Figure 8:
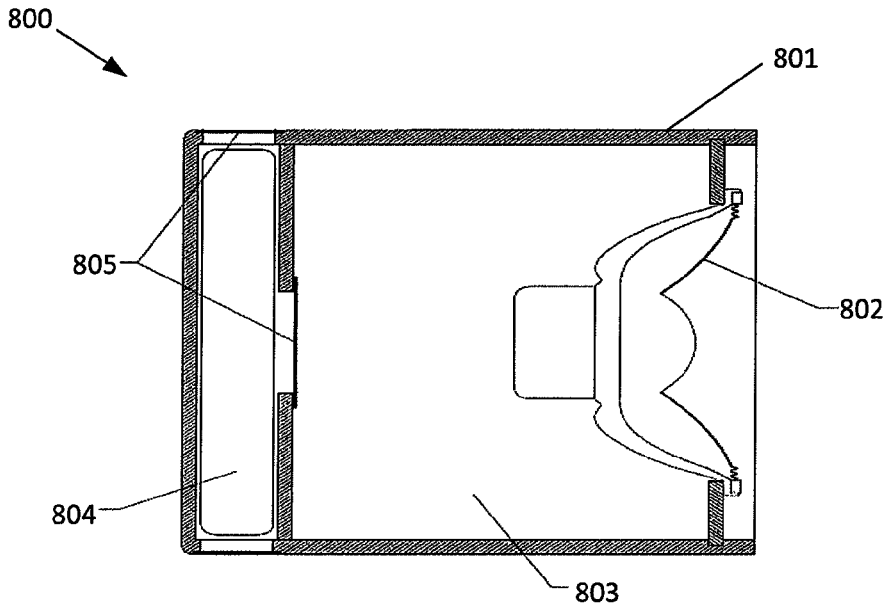
FIG. 8 depicts an example of a fourth embodiment of a passive cardioid acoustical system according to the present invention.

FIG. 8 shows an example of a fourth embodiment of a passive cardioid acoustical system 800 according to the invention. System 800 includes an enclosure 801, a diaphragm 802, an enclosed air volume 803, and an elongated duct 804 oriented perpendicularly to the primary axis of the enclosure 801. The elongated duct 804 opens to the enclosed air volume 803 near the center of the rear of the air volume 803, and (in the embodiment shown) opens to the surrounding air (surrounding the enclosure 801) through all four side walls of the enclosure 801, near the back edges of the enclosure 801. One or more acoustically resistive obstructions 805 may be located at the entrance to the duct 804, at the exit of the duct 804, within the duct 804, or at more than one of these locations.

The duct 804 formed by this construction has an inner end with a relatively small cross-sectional area, and an outer end with a relatively large cross-sectional area. The acoustical mass of the duct 804, which determines the corner frequency of the resulting low pass filter, is dominated by the relatively small cross-sectional area near the center. The relatively large cross-sectional area at the exit of the duct 804 allows large volume velocities to be emitted without producing audible turbulence.

An additional benefit of the fourth embodiment is that the exit area, length and entrance area of the duct 804 can be varied so as to provide a useful variation in phase response. This may be particularly useful when adjusting a design so as to provide rear attenuation that is consistent with frequency.

Figure 9:
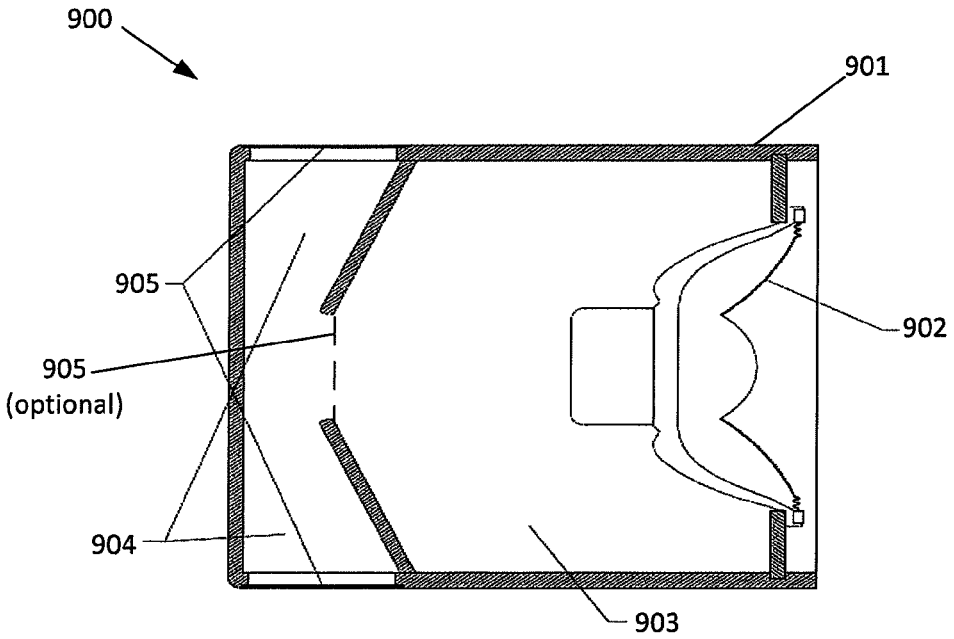
FIG. 9 depicts an example of a fifth embodiment of a passive cardioid acoustical system according to the present invention.

FIG. 9 shows an example of a fifth embodiment of a passive cardioid acoustical system 900 according to the invention. As shown, system 900 is generally similar to system 800 of FIG. 8 but also incorporates one or more tapered ducts 904. As shown, system 900 includes an enclosure 901, a diaphragm 902, an enclosed air volume 903, one or more tapered ducts 904 generally oriented perpendicularly to the primary axis of the enclosure 901. Ducts 904 are shown opening to the enclosed air volume 903 near the center of the rear of the enclosed air volume 903. In the embodiment shown, the ducts 904 may open to the surrounding air (outside of the enclosure) through, e.g., two side walls of the enclosure, near the back edges of the enclosure 901. One or more acoustically resistive obstructions 905 may be located at the entrance to the duct, at the exit of the duct, within the duct, or at more than one of these locations. This fifth embodiment thus provides the same advantages as the fourth embodiment, but offers additional flexibility in that the ducts may exit the enclosure on fewer than four sides. For example, one of the illustrated ducts 904 could be omitted, resulting in system 900 having just a single duct 904, which would open to the surrounding air on, e.g., a single side of the enclosure. This can be advantageous when a loudspeaker is intended to be floor-standing or stacked for use in multiples.

While certain preferred examples have been described above, for any of the embodiments, a single elongated duct may be replaced by multiple elongated ducts, as long as the resulting acoustical mass of the multiple ducts operating in parallel is equal to the acoustical mass of the single elongated duct. The cross-section of the ducts may take any desired shape.

Each of the embodiments presents a feature that may be combined with features from other embodiments. For example, a fourth-order acoustical low-pass filter may be combined with a short horn to achieve a specific directional pattern or to reduce the overall depth of the loudspeaker.

This invention provides significant flexibility in the selection of the various parameters, but only certain combinations of parameters will be found to be useful. Optimum parameters for a given design objective may be determined empirically, by creating a bulk-parameter mathematical model, or by modeling a particular construction in one of several commercially available acoustical finite element analysis (FEA) and/or boundary element modeling (BEM) programs. The first realization of the invention as described below was optimized using a combination of mathematical modeling and empirical measurements. The second example was optimized using COMSOL Multiphysics, a hybrid FEA/BEM analysis program.

WORKING EXAMPLES

Figure 2A:
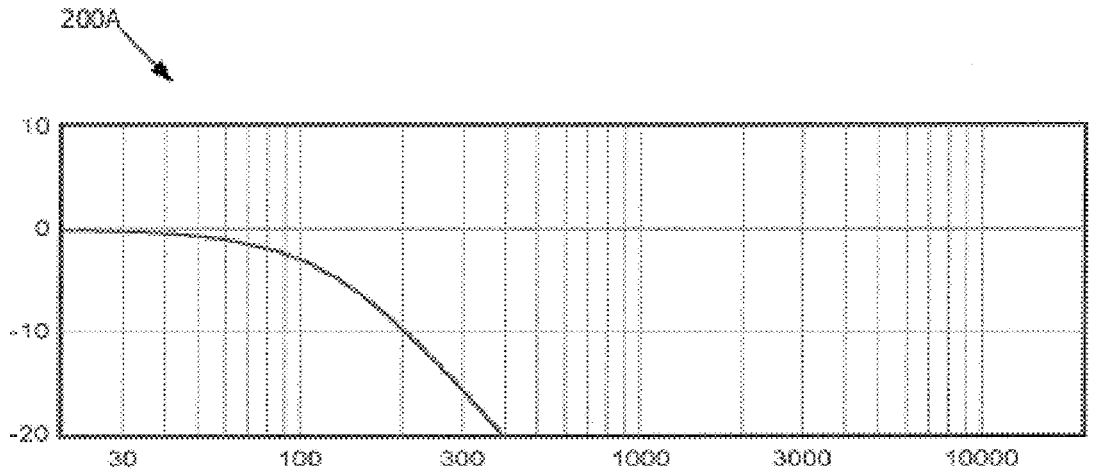
FIG. 2A (PRIOR ART)
FIG. 2A depicts a graph showing the amplitude response of a 100 Hz second-order low-pass filter vs. amplitude response of 2.08 ms of delay.
Figure 2B:
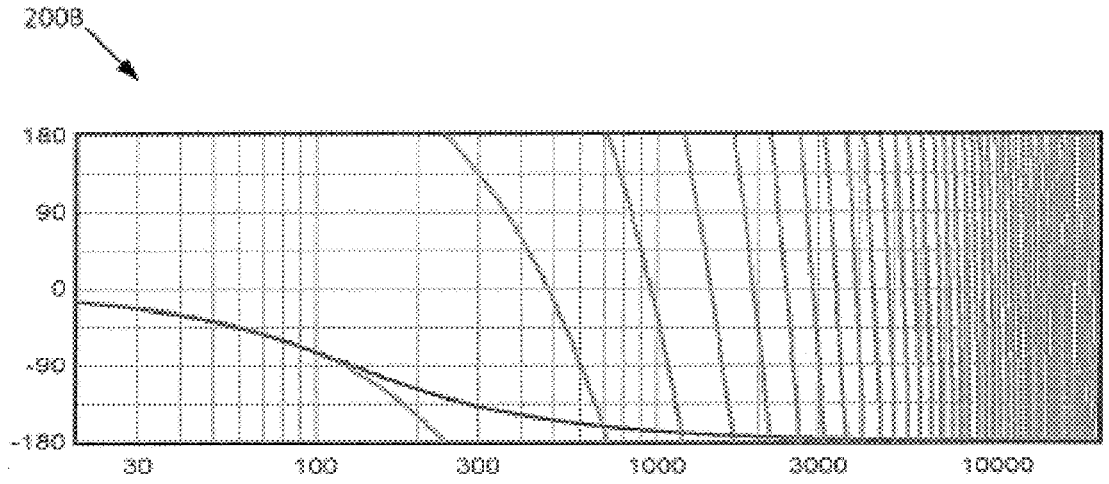
FIG. 2B depicts a graph showing the phase response of a 100 Hz second-order low-pass filter vs. phase response of 2.08 ms of delay.
Figure 3A:
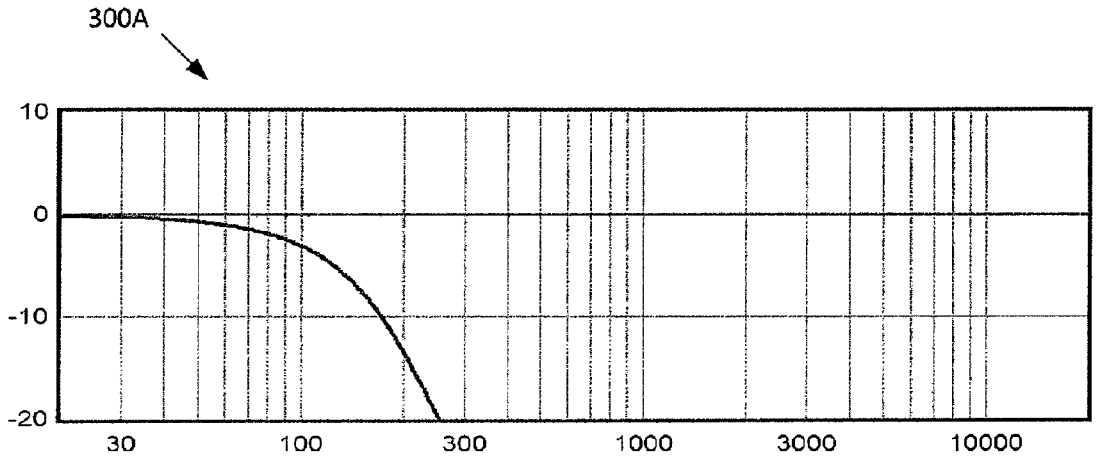
FIG. 3A depicts a graph showing the amplitude response of a 100 Hz fourth-order low-pass filter vs. amplitude response of 3.33 ms of delay.
Figure 3B:
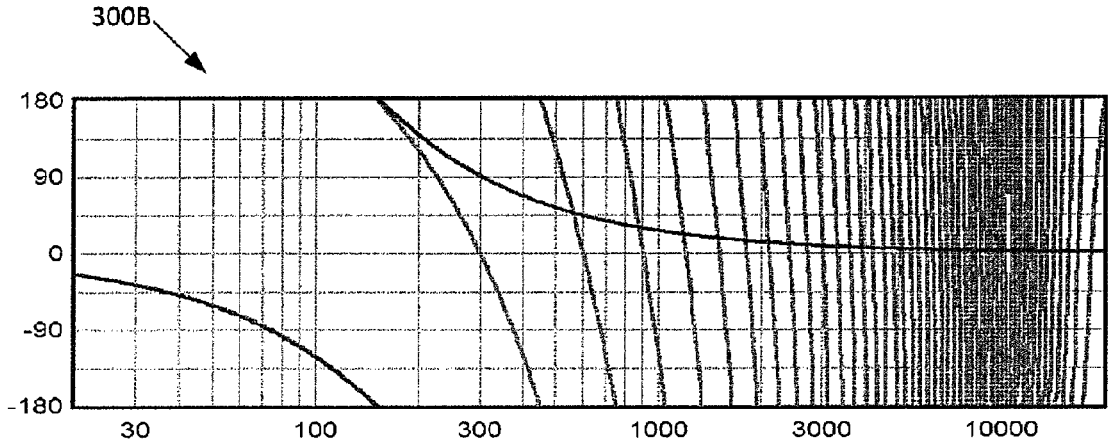
FIG. 3B depicts a graph showing the phase response of 100 Hz fourth-order low-pass filter vs. phase response of 3.33 ms of delay.
Figure 4:
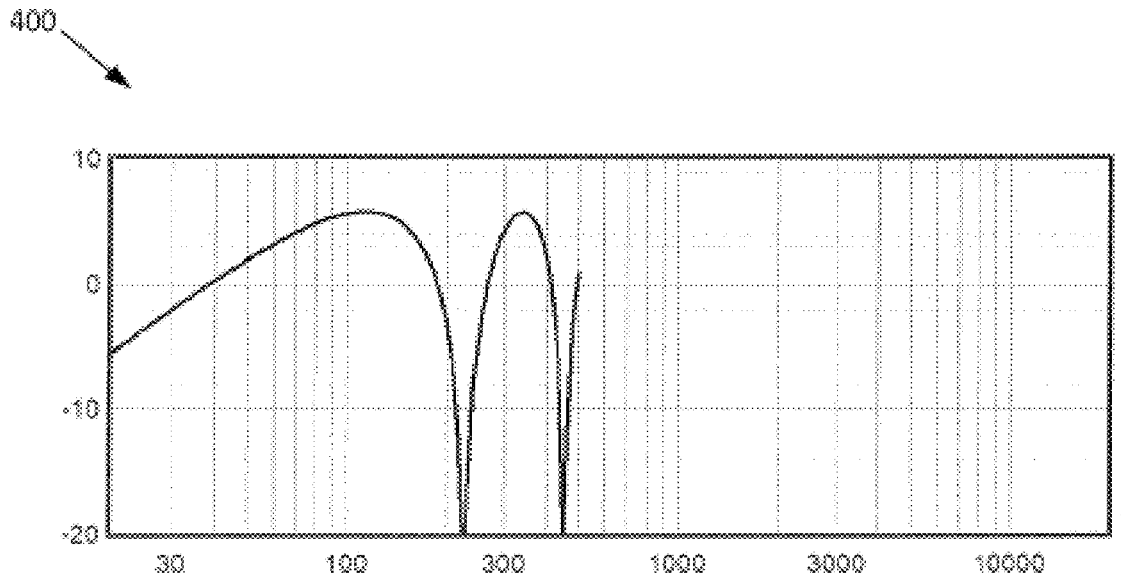
FIG. 4 (PRIOR ART)
FIG. 4 depicts a graph of the performance of certain prior art cardioid loudspeakers, showing deep nulls at odd multiples of one-half period along the forward axis of the loudspeaker.
Figure 10:
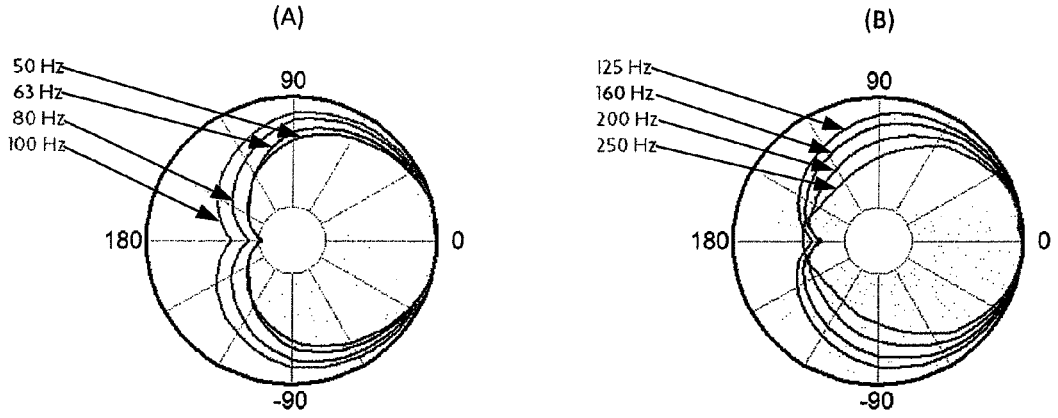
FIG. 10 depicts two plots (A)-(B) showing the measured response of an example of the second embodiment at various frequencies, plotted against the off axis angle.

An example (prototype) of the second embodiment (see FIG. 2) was designed and constructed. Its measured performance demonstrates the effectiveness of the present invention. The constructed device is an actively processed two-way loudspeaker with an operating range of 54 Hz to 19.6 kHz. The acoustical pressure response of the device was measured in various directions using a calibrated measurement microphone, and plotted in the graphs (A)-(B) shown in FIG. 10.

Figure 11:
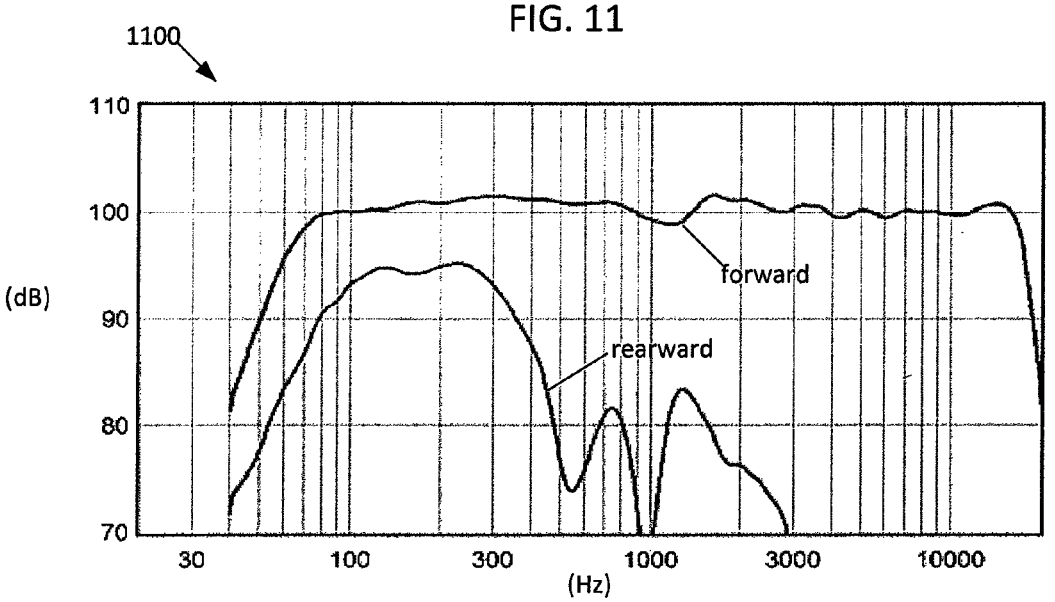
FIG. 11 depicts the measured response of the example of the second embodiment in the forward direction and rearward direction.

In the polar response graphs (A)-(B), the measured response of the device at various frequencies is plotted against the off axis angle, with a vertical scale of 1 dB per division. The relative response at 90 degrees off axis increases from 50 Hz to 100 Hz as shown in (A), then decreases from 125 Hz to 250 Hz as shown in (B). As is shown, the 50 Hz to 100 Hz frequency range is dominated by the passive cardioid behavior, and the 125 Hz to 250 Hz frequency range is dominated by the normal, non-cardioid, directivity increase, and is determined primarily by the size of the enclosure and the wall angles of the horn. The response in the forward direction and rearward direction is shown in the graph 1100 shown in FIG. 11.

Figure 12:
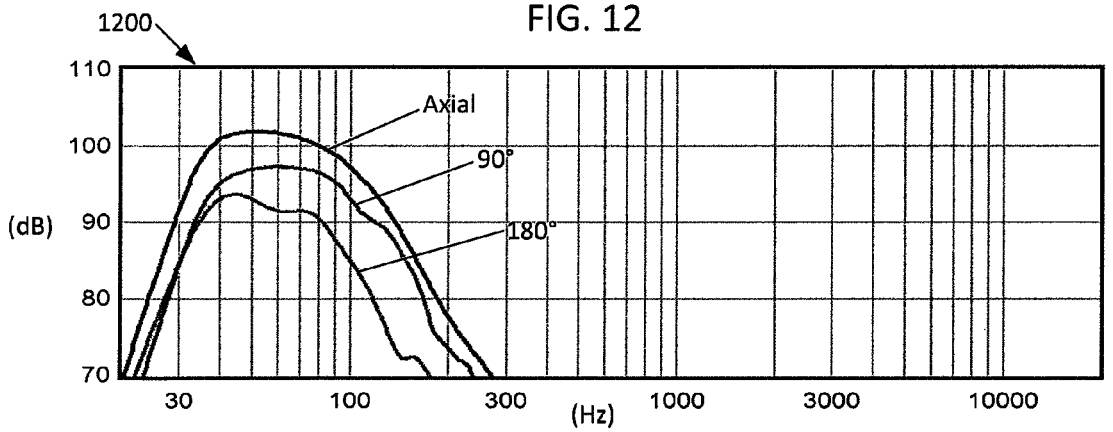
FIG. 12 depicts the measured response of an example of the fourth embodiment in the forward direction and rearward direction.

An example (prototype) of the fourth embodiment (see FIG. 8) was also designed and constructed, and its performance was measured. The loudspeaker was an actively processed subwoofer with an operating range of 29 Hz to 137 Hz. The measured response at 0 degrees, 90 degrees, and 180 degrees is plotted in the graph 1200 shown in FIG. 12.

Unless otherwise indicated, the design procedures, simulations and/or performance evaluations that have been discussed herein can be implemented with a specially-configured computer system specifically configured to perform the functions that have been described herein for the component. Each computer system includes one or more processors, tangible memories (e.g., random access memories (RAMs), read-only memories (ROMs), and/or programmable read only memories (PROMS)), tangible storage devices (e.g., hard disk drives, CD/DVD drives, and/or flash memories), system buses, video processing components, network communication components, input/output ports, and/or user interface devices (e.g., keyboards, pointing devices, displays, microphones, sound reproduction systems, and/or touch screens).

Each computer system may be a desktop computer or a portable computer, such as a laptop computer, a notebook computer, a tablet computer, a PDA, a smartphone, or part of a larger system, such a vehicle, appliance, and/or telephone system.

A single computer system may include one or more computers at the same or different locations. When at different locations, the computers may be configured to communicate with one another through a wired and/or wireless network communication system.

Each computer system may include software (e.g., one or more operating systems, device drivers, application programs, and/or communication programs). When software is included, the software includes programming instructions and may include associated data and libraries. When included, the programming instructions are configured to implement one or more algorithms that implement one or more of the functions of the computer system, as recited herein. The description of each function that is performed by each computer system also constitutes a description of the algorithm(s) that performs that function.

The software may be stored on or in one or more non-transitory, tangible storage devices, such as one or more hard disk drives, CDs, DVDs, and/or flash memories. The software may be in source code and/or object code format. Associated data may be stored in any type of volatile and/or non-volatile memory. The software may be loaded into a non-transitory memory and executed by one or more processors.

The components, steps, features, objects, benefits, and advantages that have been discussed are merely illustrative. None of them, or the discussions relating to them, are intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

For example, multiple ports with dissimilar dimensions may be used to achieve desirable results in unusual enclosure shapes; multiple ports may be placed at different distances from the front of the enclosure to obtain phase responses that vary with direction in a different manner than the variation with direction observed when all of the ports are located at the same distance from the front of the enclosure. Loudspeaker transducers of unconventional design or with unusual parameters may offer special benefits when used in passive cardioid acoustical systems. Some of the acoustical mass of a port may be replaced by a solid mass (e.g., a passive radiator) in order to reduce the delay introduced by the propagation time through the duct.

Of course, while the enclosures, or housings, have been described as having or providing one or more enclosed "air volumes," one of ordinary skill in the art will understand that such an enclosure can hold any gas or fluid, and that the scope of the present invention is not limited to working only with air. Rather, the enclosures operate with any sound-conducting fluid, e.g., air, a single-species gas such as nitrogen or oxygen, or even a liquid, e.g., water, etc.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element preceded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

The invention claimed is:

1. A passive cardioid acoustical system comprising:
an enclosure enclosing an enclosed air volume;
a diaphragm connected to the enclosure and configured to produce sound by vibration;
a duct disposed in the enclosure and having first and second apertures;
an acoustically resistive obstruction disposed across the duct; and
a horn, wherein the horn is disposed within the enclosure and holds the diaphragm in a forward facing direction, relative to the central axis of the enclosure;
wherein the acoustical system acts as a damped second-order low-pass filter, and is capable of producing a cardioid directional pattern over a range of frequencies.

2. The system of claim 1, wherein the horn comprises a surface oblique to a centerline of the diaphragm.

3. The system of claim 1, wherein the acoustically resistive obstruction is disposed across one end of the duct.

4. The system of claim 1, further comprising a second acoustically resistive obstruction disposed across the other end of the duct.

5. The system of claim 1, wherein a centerline of the duct is parallel to a centerline of the diaphragm.

6. The system of claim 1, wherein the diaphragm is held on a first side of the enclosure and a first end of the duct is disposed along a second side of the enclosure that is opposed to the first side.

7. The system of claim 1, wherein the acoustically resistive obstruction comprises one or more layers of cloth or reticulated foam.

8. The system of claim 7, wherein the acoustically resistive obstruction further comprises two layers of perforated metal, and the one or more layers of cloth or reticulated foam are clamped between the layers of perforated metal.

9. A passive cardioid acoustical system comprising:
an enclosure enclosing first and second enclosed air volumes;
a diaphragm connected to the enclosure and configured to produce sound by vibration;
a duct exiting at or near the back of the enclosure;
an acoustically resistive obstruction at one end of, or within, the duct; and
a horn, wherein the horn is disposed within the enclosure and holds the diaphragm in a forward facing direction, relative to the central axis of the enclosure;
wherein the acoustical system acts as a damped fourth-order low-pass filter, and is capable of producing a cardioid directional pattern over a range of frequencies.

10. The system of claim 9, wherein the horn comprises a surface oblique to a centerline of the diaphragm.

11. The system of claim 9, wherein the first and second enclosed air volumes are configured in series.

12. The system of claim 9, wherein the first and second enclosed air volumes are configured in parallel.

13. A passive cardioid acoustical system comprising:
an enclosure enclosing an enclosed air volume and having a primary axis;
a diaphragm connected to the enclosure and configured to produce sound by vibration;
an elongated duct disposed in the enclosure and having first and second apertures, wherein the elongated duct is oriented perpendicularly to the primary axis of the enclosure;
an acoustically resistive obstruction disposed across the duct; and
a horn disposed on the enclosure, wherein the horn holds the diaphragm in a forward facing direction, relative to the primary axis of the enclosure;
wherein the acoustical system acts as a damped second-order low-pass filter, and is capable of producing a cardioid directional pattern over a range of frequencies.

14. The system of claim 13, wherein the elongated duct is rectangular.

15. The system of claim 13, wherein the elongated duct is tapered.

16. The system of claim 14, wherein the elongated duct includes a respective aperture on one or more sides of the enclosure.

17. The system of claim 15, wherein the tapered duct includes a respective aperture on one or more sides of the enclosure.

* * * * *